US006378767B1

(12) United States Patent
Steele

(10) Patent No.: US 6,378,767 B1
(45) Date of Patent: Apr. 30, 2002

(54) SECURITY MAILBOX

(76) Inventor: Jack W. Steele, 6201 Longview Dr., Murray, UT (US) 84107

( * ) Notice: Subject to any disclaimer, the term of this patent is extended or adjusted under 35 U.S.C. 154(b) by 0 days.

(21) Appl. No.: 09/834,301

(22) Filed: Apr. 12, 2001

(51) Int. Cl.[7] ..... A47G 29/12
(52) U.S. Cl. ..... 232/19; 232/45; 232/47
(58) Field of Search ..... 232/47, 49, 51, 232/17, 45, 19, 29, 44, 43.1, 43.2, 43.5; 109/66; 220/23.83

(56) References Cited

U.S. PATENT DOCUMENTS 3,713,581 A * 1/1973 Mullens ..... 232/1 E
3,880,344 A * 4/1975 Earle ..... 232/17
3,981,436 A * 9/1976 Neal ..... 232/17
4,098,454 A 7/1978 Easter ..... 232/19
4,452,581 A * 6/1984 Panehal ..... 425/464
5,097,975 A * 3/1992 Waterston et al. ..... 220/23.83
5,137,212 A * 8/1992 Fiterman et al. ..... 232/43.2
5,207,377 A * 5/1993 Brecht ..... 232/17
5,897,054 A * 4/1999 Firth ..... 232/44
5,938,113 A * 8/1999 Kim ..... 232/47

* cited by examiner

*Primary Examiner*—Jack W. Lavinder
*Assistant Examiner*—William L. Miller
(74) *Attorney, Agent, or Firm*—Clayton, Howarth & Cannon, P.C.

(57) ABSTRACT

A security deposit mailbox that may be installed in a wall, door or other structure. A pivoting door allows items to be placed into an attached pan from which the items slide or fall through an opening when the door is closed. The pan prevents access to the opening when the door is opened. A secure storage container is provided for retaining the deposited mail when the deposit box and secure storage container are mounted in a wall or plinth. A framework that may be used in the installation, and methods of installation are also presented.

29 Claims, 3 Drawing Sheets

SECURITY MAILBOX

BACKGROUND OF THE INVENTION

1. The Field of the Invention.

The present invention relates generally to mail and drop boxes, and more particularly, but not necessarily entirely, to a security mailbox for receiving and securing items deposited therein.

2. Description of Related Art.

Virtually every home in the United States now includes a receptacle for the delivery of mail. Typically, mailboxes consist of either a small box attached to the residence with a top opening in which mail is inserted, or an elongated box with a front opening that is placed on a post in front of the residence. These mailboxes are thus always accessible. Once mail is deposited inside, it can be removed by anyone, not just those with legitimate access to the residence. With the rising problems of identity theft and credit card fraud, the prospect of stolen or intercepted mail could have grave consequences.

One attempt to resolve this problem has been through the use of mail slots in a residential door. Typically, these consist of a slot through which mail may be inserted into the residence and a flap that closes over the slot. While this allows the mail to be secured in the residence, it also allows access to that residence. It has been known for these doors to be unlocked by reaching through the slot using tools. The mail and the entire residence can thus become insecure.

In many apartments and other grouped residences, mailboxes are centrally located, and keys are relied on to control access. While this allows mail to be secured, it limits the size of the mailboxes, requires the delivery personnel to carry keys to access those boxes to deposit mail, and each user to carry additional keys to access a box to take possession of that mail. Such grouped locking mailboxes are also complex in design and manufacture with multiple moving parts and access points, and multiple keys. These limitations make such locked boxes inappropriate for a single residence dwellings, where a larger mailbox or number of keys for access are not acceptable.

The prior art is thus characterized by several disadvantages that are addressed by the present invention. The present invention minimizes, and in some aspects eliminates, the above-mentioned failures, and other problems, by utilizing the methods and structural features described herein.

BRIEF SUMMARY AND OBJECTS OF THE INVENTION

It is therefore an object of the present invention to provide a receptacle for the delivery and securing of mail and other items which is simple in design and manufacture.

It is another object of the present invention to provide such a mailbox that may be installed in a building to accept delivery of items from outside the building, without allowing access to that building.

It is an additional object of the present invention in accordance with one aspect thereof, to provide a mailbox that will securely receive and store delivered items.

It is a further object of the present invention, in accordance with one aspect thereof, to provide a mailbox that may be installed in a freestanding plinth to securely receive and retain delivered items at any suitable location.

It is an additional object of the invention, in accordance with one aspect thereof, to provide a system and method for the installation and construction of a freestanding security mailbox.

The above objects and others not specifically recited are realized in a specific illustrative embodiment of a security deposit mailbox that may be installed in a wall, door or other structure. A pivoting door allows items to be placed into an attached pan from which the items slide or fall through an opening when the door is closed. The pan prevents access to the opening when the door is opened. A secure storage container is provided for retaining the deposited mail when the deposit box and secure storage container are mounted in a wall or plinth. A framework may be used to hold the desposit box and storage container during the installation.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
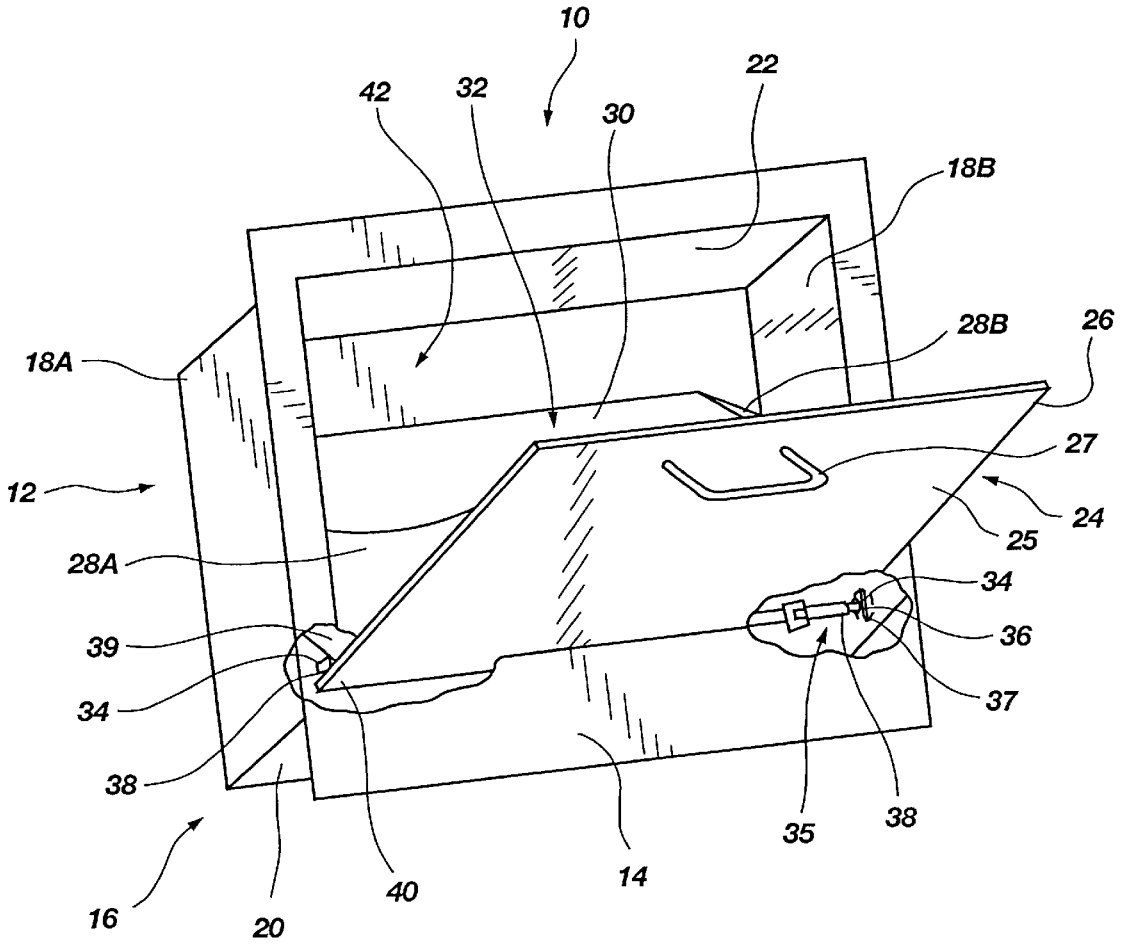
FIG. 1 is a perspective view of one embodiment of a security deposit box of a security mailbox made in accordance with the principles of the present invention, in an open position.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

It is to be understood that the terminology employed herein is used for the purpose of describing particular embodiments only and is not intended to be limiting since the scope of the present invention will be limited only by the appended claims and equivalents thereof.

It must be noted that, as used in this specification and the appended claims, the singular forms "a," "an," and "the" include plural referents unless the context clearly dictates otherwise.

Referring now to FIG. 1, generally designated at 10 is one embodiment of a security deposit box made in accordance with the principles of the present invention. A housing, generally indicated at 12, comprises a front face, 14 and a rear portion, generally indicated at 16. The rear portion, 16 is composed of two sides 18A and 18B attached to a housing bottom 20 and to a housing top 22. The front face 14 is attached to the rear portion 16. It is preferred that the housing 12 be constructed of metal, although any suitable material may be used. It is further preferred that the housing 12 be fashioned of plate steel, and most preferred that 10 gauge mild plate steel be used. It is also preferred that the front face 14 be fashioned by the bending of the pieces comprising the rear portion 16, resulting in a continuous structure.

Residing inside the housing is a pan 24, comprising a curved pan bottom 30 attached to two pan sides 28A and 28B. The pan 24 may be formed as an integral unit, or by the attachment of individual pieces to one another. A door 26 is joined to the pan 24. It is preferred that the door comprise two pieces, a door front 25 joined to the upper portion of the pan bottom 30, at the upper edge and along a portion of the rear surface of the door front 25. This allows for the interior of the pan 24 to have a smooth surface from the top of the door 26 to the rear of the pan bottom 30.

As with housing 12, it is preferred that the pan 24 be constructed of metal, although any suitable material may be used. It is further preferred that the pan 24 be fashioned of plate steel, and most preferred that 10 gauge mild plate steel be used.

A handle 27 may be attached to the door 26, for the convenience of a user in operating the box 10. It is preferred that the handle be a pull loop fashioned from cold roll steel, although any suitable handle will suffice and is within the scope of the present invention. Preferably, the handle 27 passes through holes formed in the door front 25 and is welded to the rear surface of the door front. In embodiments where the pan bottom 30 is joined to the door front 25 the joining of the handle 27 to the door front 25 is covered by the pan bottom, resulting in a pan 24 with a smooth interior. Optionally a sign or label may be placed upon the door 26, this allows for multiple labeled boxes to be conveniently installed and used at a single location for acceptance of multiple types of deliveries.

The pan 24 is attached to the housing 12 such that it may pivot to allow access to a the pan interior, generally represented at 32. In the FIG. 1 embodiment, the pan is attached by a pivoting means comprising a hinge 35 formed at the bottom of the pan 24. Two shafts 34 are disposed through the respective openings 36 in housing 12, located posterior to front face 14. Each shaft 34 protrudes through holes 36 in the housing sides 18. It is preferred that a securing device be placed outside the holes 36, on the shaft 34, to prevent the shaft 34 from coming out of the housing 12. The preferred device is a cap 37 located on the end of the shaft 34, although a cotter pin placed through a hole in the shaft 34, or any other suitable securing device may be used and is within the scope of the present invention. In one preferred embodiment, the shafts 34 are separate pieces attached at either end, although it is within the scope of the present invention to join the shafts 34 to form a single shaft the width of the housing 12. It is preferred that shafts 34 be fashioned from cold roll steel, although any suitable material may be used and is within the scope of the present invention.

Residing on the shafts 34 is a pipe 36, that can rotate on the shaft 34. The pipe 36 is attached to the pan 24, preferably by welding. The pipe 36, preferably resides under the pan 24, and is located behind a flange 40 comprising the lower portion of the door front 25. This location prevents access to the pipe 36 and shaft 34, securing the hinge 35.

It will be appreciated that the structure and apparatus disclosed herein is merely one example of a means for pivoting, and it should be appreciated that any structure, apparatus or system for pivoting which performs functions the same as, or equivalent to, those disclosed herein is intended to fall within the scope of a means for pivoting, including those structures, apparatus or systems for pivoting which are presently known, or which may become available in the future. Anything which functions the same as, or equivalently to, a means for pivoting falls within the scope of this element.

Optionally, the security deposit box 10 may be treated with any suitable surface treatment, such as anodization, enameling, painting or any other surface treatment known now or in the future to those skilled in the art. It is preferred that the deposit box 10 be powder coated. Such a coating provides a smoother surface, assisting the movement of inserted items over the pan.

When the security deposit box 10 is installed in a door, or exterior wall of a building, the front face 14 and door face 25 are exposed. Letters, or packages may be delivered to the building through the deposit box 10. A user pulls on the handle 27, the door 24 pivots forward exposing the interior of the pan 24. Items are placed in the pan 24, and the door 26 is closed. When the door is closed, the pan 24, pivots to slope downward, items slide down the interior surface of the pan 24, passing through the opening 42. When installed in a door way, or wall, the items delivered are now secure inside the building. It is important to note that when the door 24 is pivoted forward the pan bottom 30 pivots upward, preventing access to the opening 42. The deposit box 10 thus provides a secure way to deliver mail and packages into a residence, without the insecurities of a mail slot.

Figure 2:
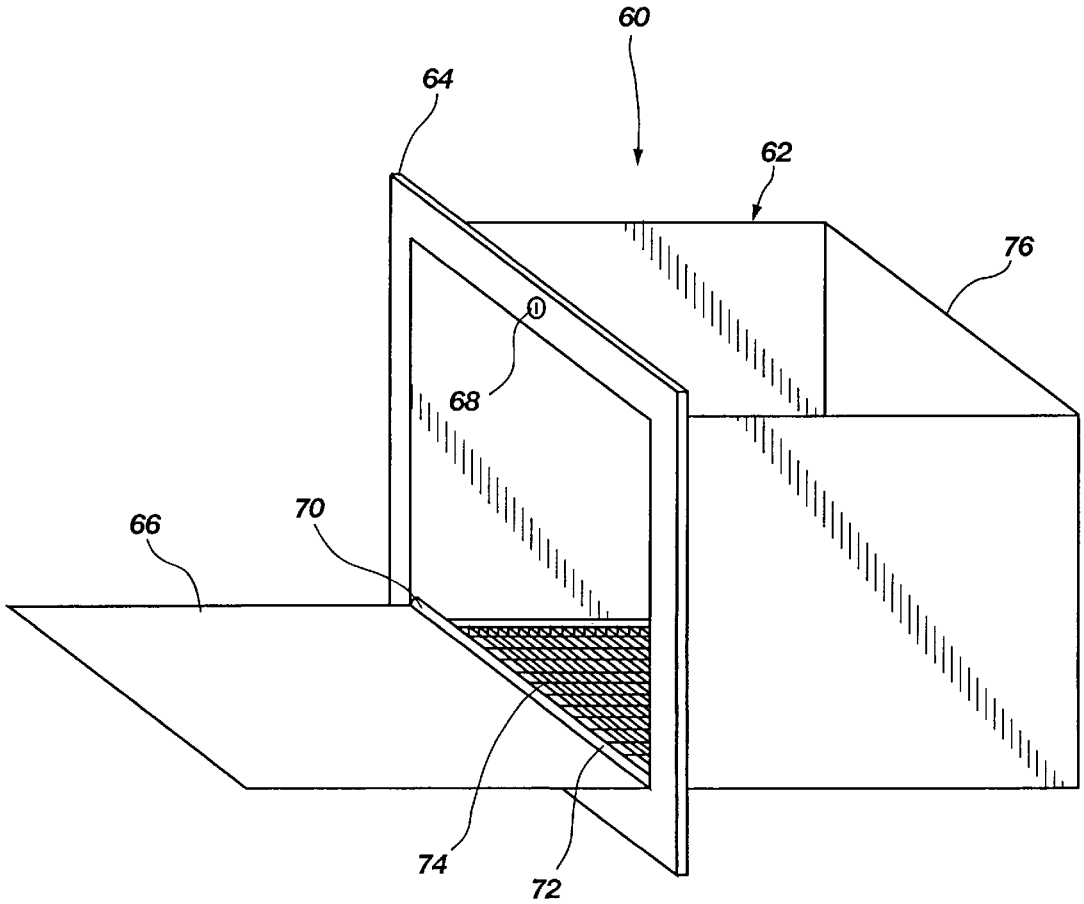
FIG. 2 is a perspective view of embodiment of a security storage box for use with the security deposit box of FIG. 1, made in accordance with the principles of the present invention, in an open position.

Turning now to FIG. 2, in accordance with the principles of the present invention, one possible embodiment of a storage box 60 that may be used in some embodiments of the present invention is shown. The FIG. 2 embodiment consists of a box body 62 and a box front face 64. The box body 62 may be fashioned in any suitable configuration, but it is preferred to that the box body 62 be cubic or rectangular. It is preferred that the box face 64 extend beyond the box body 62. The box face 64 maybe shaped into any suitable design.

A door 66 is disposed in the box face 64, allowing access to the interior of the box 60. When the door 66 is placed in a closed position the box 60 may be secured closed by a securing means. In the FIG. 2 embodiment, the securing means is the lock 68 accessible by the keyhole located on the box face 64. It will be appreciated that any suitable securing device, such as all locks and latches now known, or known in the future, to those skilled in the art my be used as a securing means and all such devices are within the scope of the present invention. It will be further appreciated that the securing means can be located on the box face 64, the door 66 (as indicated by reference numeral 68*a* in FIG. 4B), or the box body 62.

Preferably, the door 66 may be opened and closed by the action of any suitable pivot means. One such means is disclosed in FIG. 2 as the hinge 70. This hinge is consists of a pipe 72 that turns on one or more shafts, similar to that disclosed at parts 34 and 38 in FIG. 1. It will be appreciated that any suitable pivot means may be used and is within the scope of the present invention. Optionally a removable screen 74 may be placed inside the storage box 60 to aid in the removal of deposited items.

The storage box 60 may be constructed of any suitable material, but is preferably constructed from metal. More preferably, the box 60 is constructed of plate steel, and most preferably from gauge 10 mild plate steel. As with the deposit box 10, the storage box 60 may be treated with any suitable coating, but is preferably powder coated.

When a deposit box 10, such as that depicted in FIG. 1, is installed, a storage box 60 such as that disclosed in FIG. 2 may be installed below it. This provides a secured storage area for the storage of the items, such as mail, deposited in the deposit box 10. This can be done at any suitable location, as in a building wall.

Alternatively, a plinth may be constructed of brick, stone, concrete, mortar, plastic material such as vinyl, metal, or any other suitable material and the deposit box 10 and storage box 60 installed therein. This allows for the secure receipt of mail at locations where the deposit box 10 may not be installed in a building. Such a plinth may be used as a curbside mailbox or drop box to securely retain deposited items.

Figure 3:
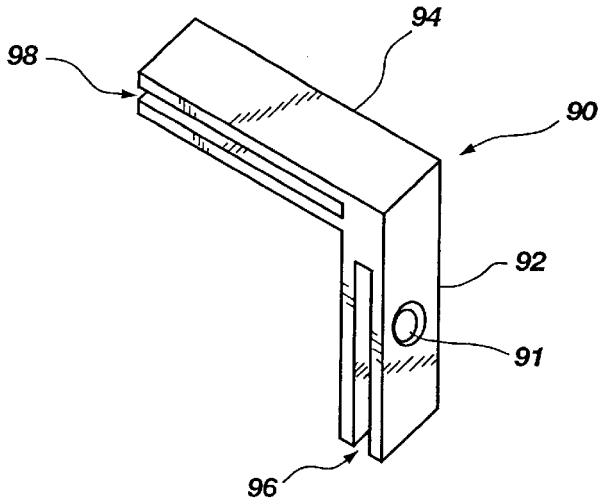
FIG. 3 is a perspective view of a fastener useful for constructing and arranging the members of a mailbox system in accordance with the present invention.

FIG. 3 shows a fastening strap 90 useful for attaching the security deposit box 10 to the storage box 60 in the proper conformation. This fastening strap 90 is useful in constructing a freestanding plinth or a wall containing the security mailbox system, as well as for installing the security mailbox system inside an existing structure.

In preferred embodiments the fastening strap 90 comprises a lower portion 92 attached at an angle to an upper portion 94. Lower portion 92 includes a lower slot 96 and upper portion 94 includes an upper slot 98.

Figure 4A:
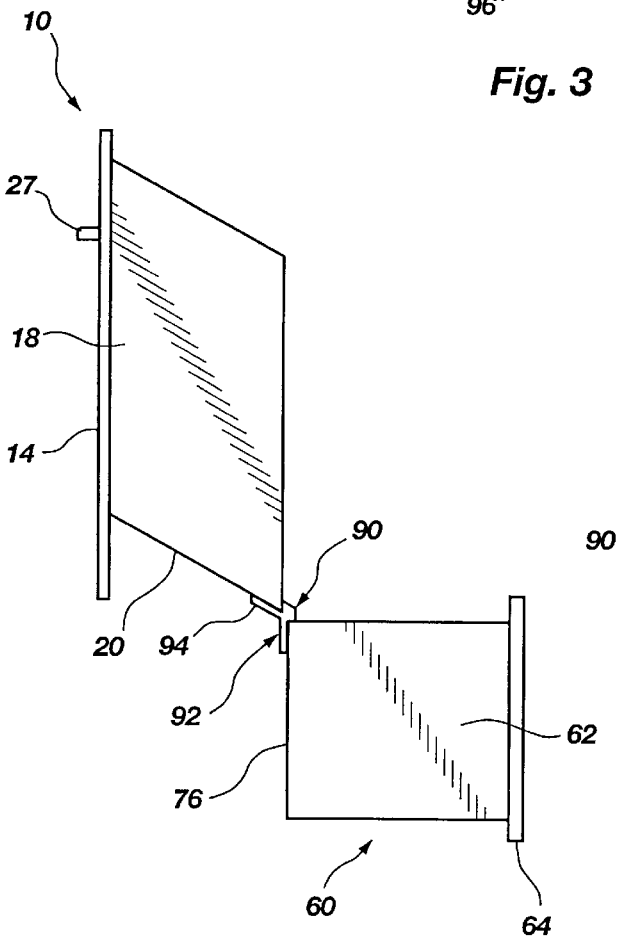
FIG. 4A is a side view of the embodiments of FIG. 1 and FIG. 2, attached to one another using the fastener of FIG. 3.
Figure 4B:
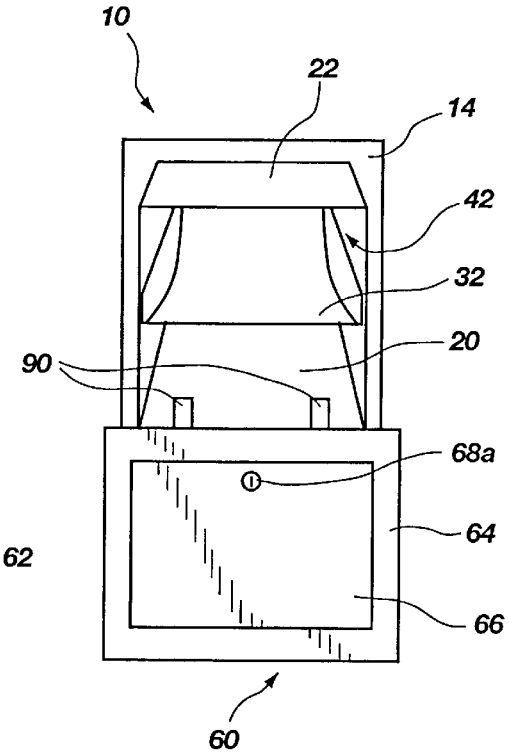
FIG. 4B is a rear view of the embodiments of FIG. 1 and FIG. 2, attached to one another using the fastener of FIG. 3.

Turning to FIGS. 4A and 4B the connection of a security deposit box 10 and a storage box 60 using fastener 90 is shown. While a single fastener 90 may be used, it is preferred that at least two fasteners 90 be used, as shown in FIG. 4B. The lower portion 92 of the fastener 90 is attached to the back wall 76 of box body 62 of the storage box 60. Lower slot 96 fits tightly over back wall 76. In some preferred embodiments a bolt or other securing device may be placed through the faster 90 and back wall 76 to secure the fastener 90 in place. Certain of these preferred fastener 90 embodiments have an aperture 91 formed through the lower portion 92 to allow for the insertion of a bolt or other securing device.

The security deposit box 10 is attached to the fastener 90 by sliding the housing bottom 20 into the upper slot 98 of the fastener 90, resulting in the attachment of the security deposit box 10 to the storage box 60. This attachment is at an angle allowing items deposited in the security deposit box 10 to fall through the opening 42 and into the storage box 60. It is preferred that the angle be the same as the pitch of the housing bottom 20, although other angles that may be readily ascertained by those skilled in the art may be used.

While a bolt or other securing device may be passed through the upper portion 94 of fastener 90 and the housing bottom to secure the security mailbox 10 to the fastener, it is preferred that no such securing be done. This allows a smooth upper surface of the upper portion 92 to be exposed, reducing the chance items deposited in the security deposit box 10 will be caught on the fasteners 90 as the pass through opening 42.

While fastener 90 may be constructed from any suitable material, it is preferred that it be fashioned of steel. The fastener may be fashioned in any shape that attaches the two boxes 10 and 60 in the proper conformation. It is preferred that the faster 90 be formed by bending two steel strips to form an upper and a lower portion with channels formed by the bending, and then welding the upper portion to the lower portion at an appropriate angle. If desired, the fasteners may be painted, anodized, powder coated or given any other suitable surface treatment.

In accordance with the features and combinations described above, a preferred method of installing a security mailbox in a freestanding plinth comprises:

(a) constructing a foundation for a plinth;

(b) installing a security storage box on the foundation;

(c) attaching at least one fastener to the security storage box;

(d) attaching a security deposit box to the at least one fastener; and (e) completing the construction of the plinth.

It is to be understood that the above steps may be taken in any order, and are not intended to be sequentially listed. It is preferred that two or more fasteners be used to attach the security deposit box to the storage box. It is further preferred to use a security deposit box and a security storage box made in accordance with the principles of the present invention as described above.

In accordance with the features and combinations described above, a preferred method of storing and safekeeping delivered items into a security mailbox system installed in a preexisting structure comprises:

(a) selecting a security deposit device comprising
- a rear portion suitable for installation in a wall, the rear portion containing an opening allowing items to pass therethrough;
- a front face attached to the rear portion;
- a door pivotally attached to the front face, the door having an open position and a closed position;
- a securing structure attached to the door, such that items are able to pass through the opening when the door is in the closed position and when the door is pivoted to an open position access to the opening is prevented;

(b) recessing the security deposit device within a preexisting structure of a building, such that the door is accessible on a first surface of the structure and the opening allows access to a second surface of that structure;

(c) placing one or more items though the open door of the security deposit device; and (d) pivoting the door to a closed position such that the items move through the opening to a position accessible from the second surface of the preexisting structure.

The preexisting structure may be a wall or a door of a building. The deposit box may allow for items to be deposited from a publicly accessible part of a building, such as a room or hall, to a non-publicly accessible room.

It is further preferred to install a secure storage container, in accordance with the principles of the present invention into the same preexisting structure, such that deposited items may be securely stored until they are collected. The storage container may be accessible from the same side of the preexisting structure as the security deposit box, or it may be accessible from a different or opposite side.

It is preferred to install the security deposit box and secure storage container of the present invention so that the doors of the two components may be accessed at a height that is convenient for users of the system. This provides an advantages over mail slots, which typically allow the items passed therethrough to fall onto the floor, or ground. It also provides an advantage over other systems that require a user to bend, or kneel down, to access their mail. This advantage can be of great benefit to those with limited mobility. It is preferred that the system be mounted so the door of the secure storage container is at a height in the range of from about 24 inches to about 60 inches. It is further preferred that the door of the security deposit box be mounted at a height in the range of from about 30 to about 66 inches.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

The subject matter claimed is:

1. A security mailbox system comprising:

a security deposit device comprising a rear portion configured for installation in a wall or plinth, the rear portion containing an opening configured for allowing items to pass therethrough;

a front face attached to the rear portion;

a door pivotally attached to the front face, the door having an open position and a closed position;

a securing structure attached to the door, such that items pass through the opening when the door is in the closed position and when the door is pivoted to an open position access to the opening is prevented;

wherein said rear portion includes a sloped housing bottom for directing said items to said opening.

2. The security mailbox system of claim 1, wherein the securing structure further comprises a pan attached to the door, the pan disposed inside the rear portion, the pan shaped such that items placed in the pan pass through the opening when the door is in the closed position and when the door is pivoted to an open position access to the opening is prevented.

3. The security mailbox system of claim 1, wherein the door is pivotally attached to the front face using a hinge.

4. The security mailbox system of claim 3, wherein the hinge further comprises a pipe attached to the bottom of the door, said pipe disposed on one or more rods attached to the rear portion.

5. The security mailbox system of claim 1, further comprising a secure storage container disposed for receiving the items that pass through said opening.

6. The security mailbox system of claim 5, wherein the secure storage container further comprises a container body with a container face, the container face containing a container door configured for allowing access to the secure storage container.

7. The security mailbox system of claim 6, wherein the container door is pivotally attached to the container face using a container hinge.

8. The security mailbox system of claim 7, wherein the container hinge further comprises a pipe attached to the bottom of the door, said pipe disposed on one or more rods attached to the container body.

9. The security mailbox system of claim 6, wherein the container door may be secured closed by a locking mechanism accessible on a surface of the container door.

10. The security mailbox system of claim 6, wherein the container door may be secured closed by a locking mechanism accessible on the container face.

11. The security mailbox system of claim 5, wherein the secure storage container further comprises a container body having an open top for receiving items that pass from the opening of the security deposit device.

12. A security mailbox system comprising:

a security deposit device comprising a rear portion configured for installation in a wall or plinth, the rear portion containing an opening configured for allowing items to pass therethrough;

a front face attached to the rear portion;

a door pivotally attached to the front face, the door having an open position and a closed position;

a securing structure attached to the door, such that items pass through the opening when the door is in the closed position and when the door is pivoted to the open position access to the opening is prevented;

wherein the security mailbox system further comprises a secure storage container disposed for receiving the items that pass through said opening;

wherein the secure storage container further comprises a container body having an open top for receiving items that pass from the opening of the security deposit device;

wherein the container body further comprises a back wall, and the rear portion further comprises a housing bottom, said security mailbox system further comprising a fastener attached to the container body back wall and to the housing bottom, the fastener connecting the rear portion to the secure storage container.

13. The security mailbox of claim 12, where the fastener comprises an upper portion with an upper slot for receiving the housing bottom, said upper portion attached at an angle to a lower portion with a slot for receiving the container body back wall.

14. The security mailbox of claim 13, where the lower portion includes an aperture formed therethrough for the insertion of a securing device, for securing the fastener to the container back wall.

15. The security mailbox of claim 14, where the securing device comprises a bolt.

16. The security mailbox of claim 13, where the upper portion and lower portion are formed by two pieces of steel strap, folded to form said upper slot and said slot in said lower portion, said upper portion and said lower portion are attached to one another at an appropriate angle.

17. The security mailbox of claim 12, where the fastener attaches the security deposit device to the secure storage container, such that the passage of items from the opening through the open top is facilitated.

18. The security mailbox of claim 17, where the security deposit device is disposed above the attached secure storage container.

19. A security mailbox system comprising:

a security deposit device having an opening for passing items therethrough, said security deposit device having a housing bottom;

a secure storage container for receiving said items, said secure storage container comprising a back wall; and a fastener, said fastener having an upper portion with an upper slot for receiving the housing bottom, and a lower portion having a lower slot for receiving said back wall;

wherein said security deposit device is attached to said secure storage container by said fastener.

20. The security mailbox system of claim 19, wherein said security deposit device further comprises a door including a securing structure such that items pass through the opening when the door is in the closed position and when the door is pivoted to an open position access to the opening is prevented.

21. The security mailbox system of claim 20, wherein the securing structure comprises a pan attached to the door.

22. The security mailbox system of claim 19, further comprising a door pivotally attached to the security deposit device using a hinge.

23. The security mailbox system of claim 22, wherein the hinge further comprises a pipe attached to a bottom of the door, said pipe disposed on at least one rod attached to the security deposit device.

24. The security mailbox system of claim 19, wherein the secure storage container further comprises a container body with a container face, the container face containing a container door configured for allowing access to the secure storage container.

25. The security mailbox system of claim 24, further comprising a locking mechanism to secure the container door.

26. The security mailbox of claim 19, wherein said upper portion is attached at an angle to said lower portion.

27. The security mailbox of claim 19, wherein the lower portion includes an aperture formed therethrough for the insertion of a securing device, for securing the fastener to the container back wall.

28. The security mailbox of claim 27, wherein the securing device comprises a bolt.

29. The security mailbox of claim 19, wherein the upper portion and the lower portion are formed by two pieces of steel strap, folded to form channels and attached to one another at an appropriate angle.

* * * * *